US006999597B2

(12) United States Patent
Yang

(10) Patent No.: US 6,999,597 B2
(45) Date of Patent: Feb. 14, 2006

(54) SPEAKER STACKING STRUCTURE

(75) Inventor: Tony Yang, Taichung (TW)

(73) Assignee: Sekaku Electron Industry Co., Ltd., Taichung (TW)

( * ) Notice: Subject to any disclaimer, the term of this patent is extended or adjusted under 35 U.S.C. 154(b) by 222 days.

(21) Appl. No.: 10/751,492

(22) Filed: Jan. 6, 2004

(65) Prior Publication Data

US 2005/0123165 A1 Jun. 9, 2005

(51) Int. Cl.
*H04R 25/00* (2006.01)

(52) U.S. Cl. ..... 381/386; 381/182; 381/395; 181/145

(58) Field of Classification Search ..... 381/300, 381/303–305, 307, 309, 332, 334, 335, 345, 381/182, 186, 386–388, 395, 124; 181/144–145, 181/199

See application file for complete search history.

(56) References Cited

U.S. PATENT DOCUMENTS

| | | | | | |
|---|---|---|---|---|---|
| 2,632,055 | A | * | 3/1953 | Parker | 381/335 |
| 4,757,544 | A | * | 7/1988 | Guy | 381/387 |
| 4,908,601 | A | * | 3/1990 | Howze | 381/182 |
| 5,146,508 | A | * | 9/1992 | Bader et al. | 381/182 |
| 5,550,926 | A | * | 8/1996 | Tsao | 381/386 |
| 5,758,852 | A | * | 6/1998 | Martin | 381/386 |
| 5,996,728 | A | * | 12/1999 | Stark | 181/144 |

* cited by examiner

*Primary Examiner*—Suhan Ni
(74) *Attorney, Agent, or Firm*—Bacon & Thomas, PLLC

(57) ABSTRACT

A speaker stacking structure includes a speaker, the speaker having two bearing walls at two sides of the speaker cabinet thereof, a plurality of locating blocks respectively symmetrically fastened to the bearing walls of the speaker, each locating block having a plughole, and a plurality of fastening members insertable into the plugholes of the locating blocks to join two speakers in a stack.

10 Claims, 6 Drawing Sheets

SPEAKER STACKING STRUCTURE

BACKGROUND OF THE INVENTION

1. Field of the Invention

The present invention relates generally to speakers and, more specifically, to a speaker stacking structure, which enables a number of speakers to be conveniently positively arranged in a stack.

2. Description of the Related Art

In some cases, speakers may be arranged in a stack. However speakers may fall to the ground upon a vibration or impact if they are simply put one above another. Therefore, positioning members must be used to fix speakers in position after arranged in a stack. There are speaker racks adapted to hold a number of speakers at different elevations. However, these speaker racks are designed to fit specific size or sizes of speakers, not practical for holding assorted sizes of speakers.

Therefore, it is desirable to provide a speaker stacking structure that eliminates the aforesaid problems.

SUMMARY OF THE INVENTION

The present invention has been accomplished under the circumstances in view. It is the main object of the present invention to provide a speaker stacking structure, which enables a number of speakers to be arranged in a stack without the use of any other positioning structure or apparatus. It is another object of the present invention to provide a speaker stacking structure, which keeps the arranged stack of speakers firmly in unity to cause a sense of beauty. It is still another object of the present invention to provide a speaker stacking structure, which enables a number of speakers of different sizes to be arranged in a stack to form one of a variety of combinations.

To achieve these and other objects of the present invention, the speaker stacking structure comprises a speaker, the speaker having a speaker cabinet, the speaker cabinet having a receiving chamber adapted to accommodate speaker circuit means, and two bearing walls disposed at two opposite sides; a plurality of locating blocks respectively symmetrically fastened to the bearing walls of the speaker, the locating blocks each having a block body, the block body having a mounting face and a bearing face opposite to the mounting face, the mounting face being disposed in contact with the bearing wall of the speaker, the bearing face being disposed in contact with the bearing face of another locating block, a mounting device respectively fastened to said bearing wall of the speaker, and a plughole; and a plurality of fastening members adapted to connect two speakers together, the fastening members each having a stem insertable into the plughole of each said locating block.

DETAILED DESCRIPTION OF THE INVENTION

Figure 1:
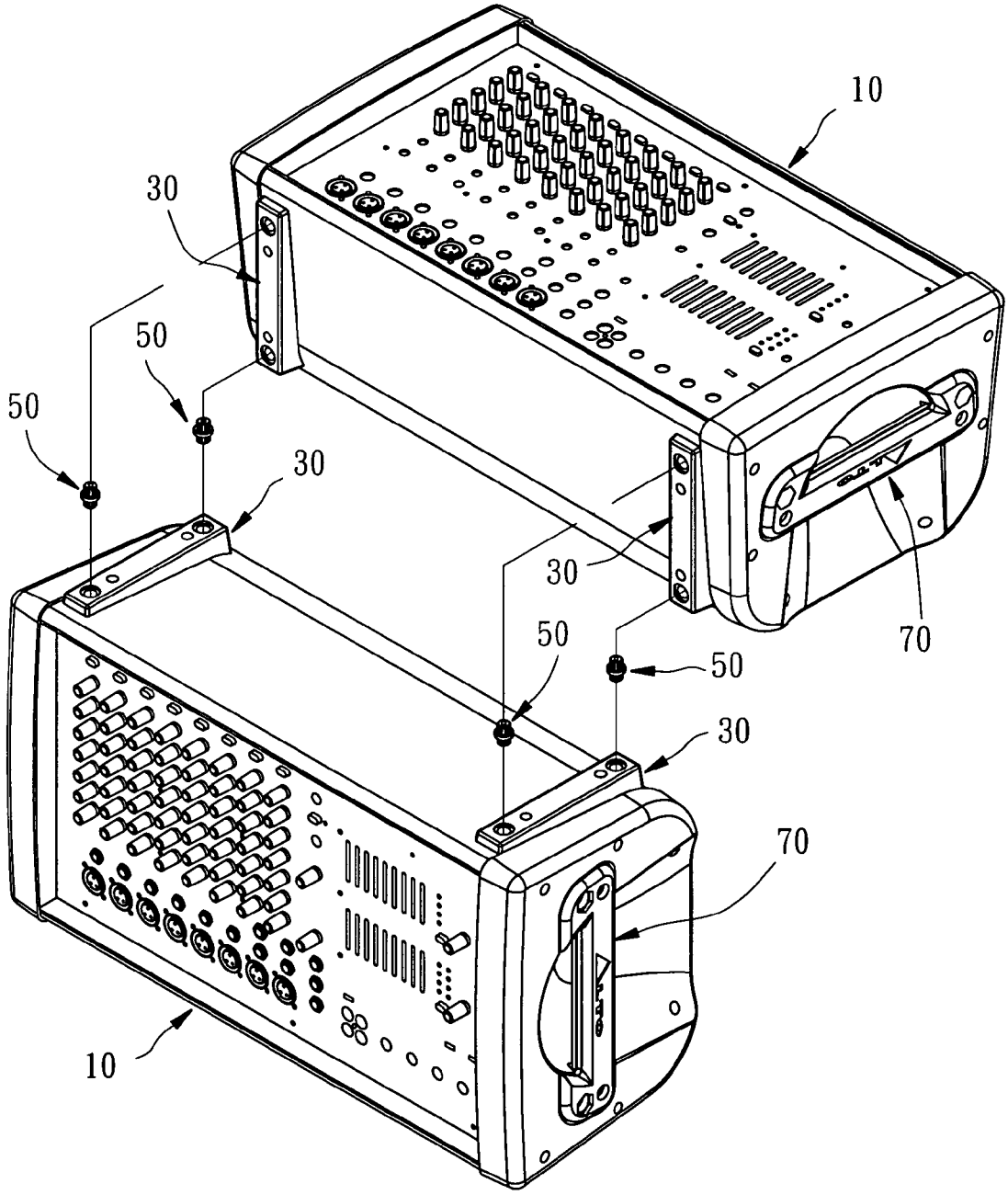
FIG. 1 is an exploded view of two speakers constructed according to the present invention.

Referring to FIGS. 1~5, a speaker stacking structure in accordance with the present invention is shown including a speaker 10, a plurality of locating blocks 30, a plurality of fastening members 50, and two handles 70.

The speaker 10 has a speaker cabinet 11 defining a receiving chamber 12 adapted to accommodate speaker circuit means (not shown). The speaker cabinet 11 has two opposite bearing walls 13, a plurality of mounting holes 14 symmetrically formed in the bearing walls 13 (for example, four mounting holes in each bearing wall), two handle holders 15 respectively disposed at two ends of the longitudinal axis, and a plurality of tie holes 16 symmetrically formed in the handle holders 15 (for example, four tie holes in each handle holder).

The locating blocks 30 each have a wedge-like block body 31. The wedge-like block body 31 has a mounting face 33 disposed at a bottom side of the block body 31, a bearing face 34 disposed at a top side of the block body 31 opposite to the mounting face 33, two mounting devices (for example, countersunk holes) 35 for fastening to the mounting holes 14 of the speaker cabinet 11 by screws B1, two tapered plugholes 37, and two countersunk holes 38 respectively formed in the bearing face 34 integral with the orifices of the tapered plugholes 37.

The fastening members 50 each have a tapered stem 51 for plugging into the tapered plugholes 37 of the locating blocks 30, a shoulder 53 for fitting into the countersunk holes 38 of the locating blocks 30, threads 55 extended around the periphery of the stem 51, and an axle hole 57 axially extended through the two ends.

The handles 70 each have a handle body 71, and two mounting portions 73 respectively extended from two ends of the handle body 71 for fastening to the tie holes 16 in the handle holders 15 by screws B2 for enabling the user to carry the speaker 10 with one or both hands.

Figure 2:
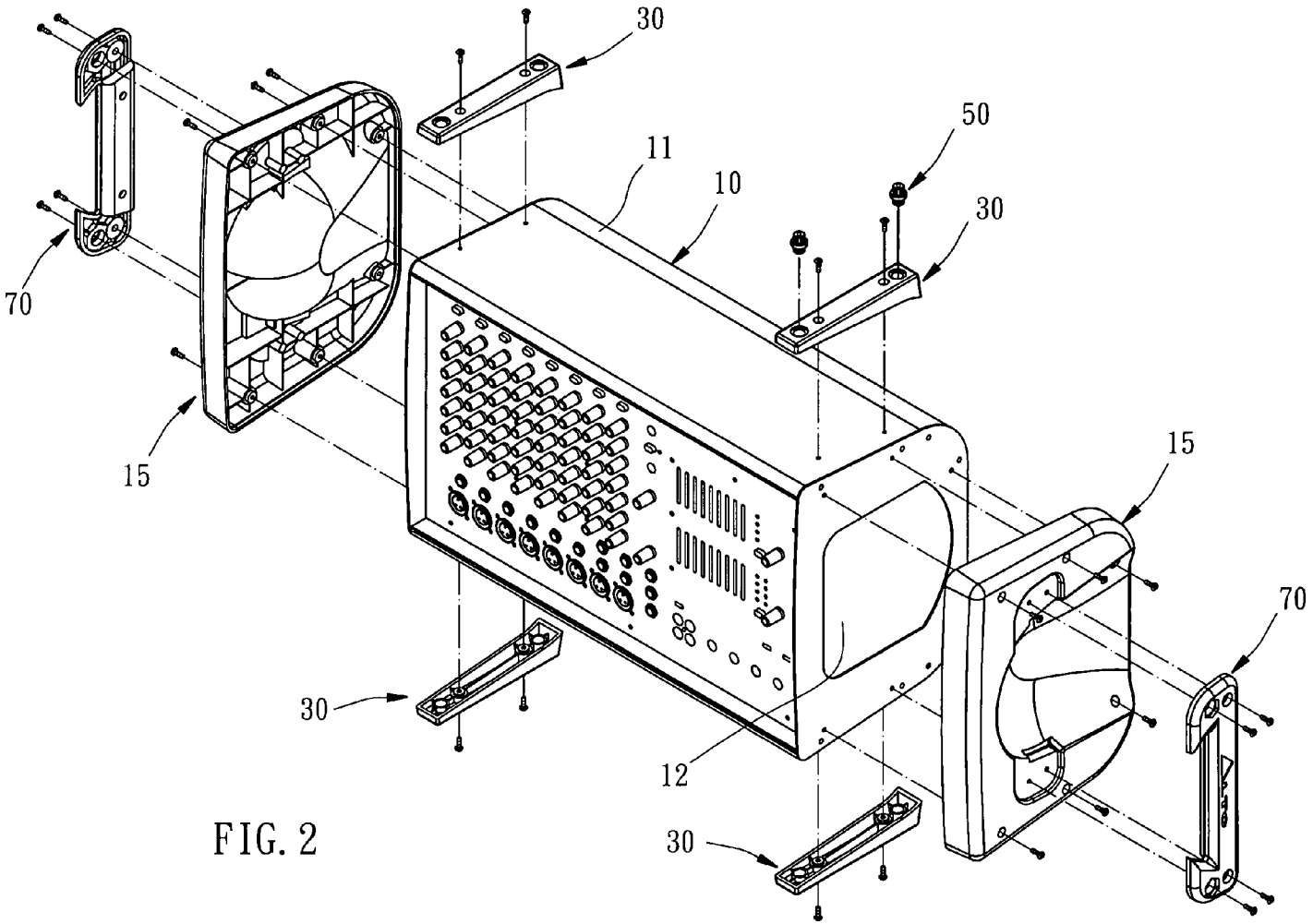
FIG. 2 is an exploded view of a speaker stacking structure according to the present invention.
Figure 3:
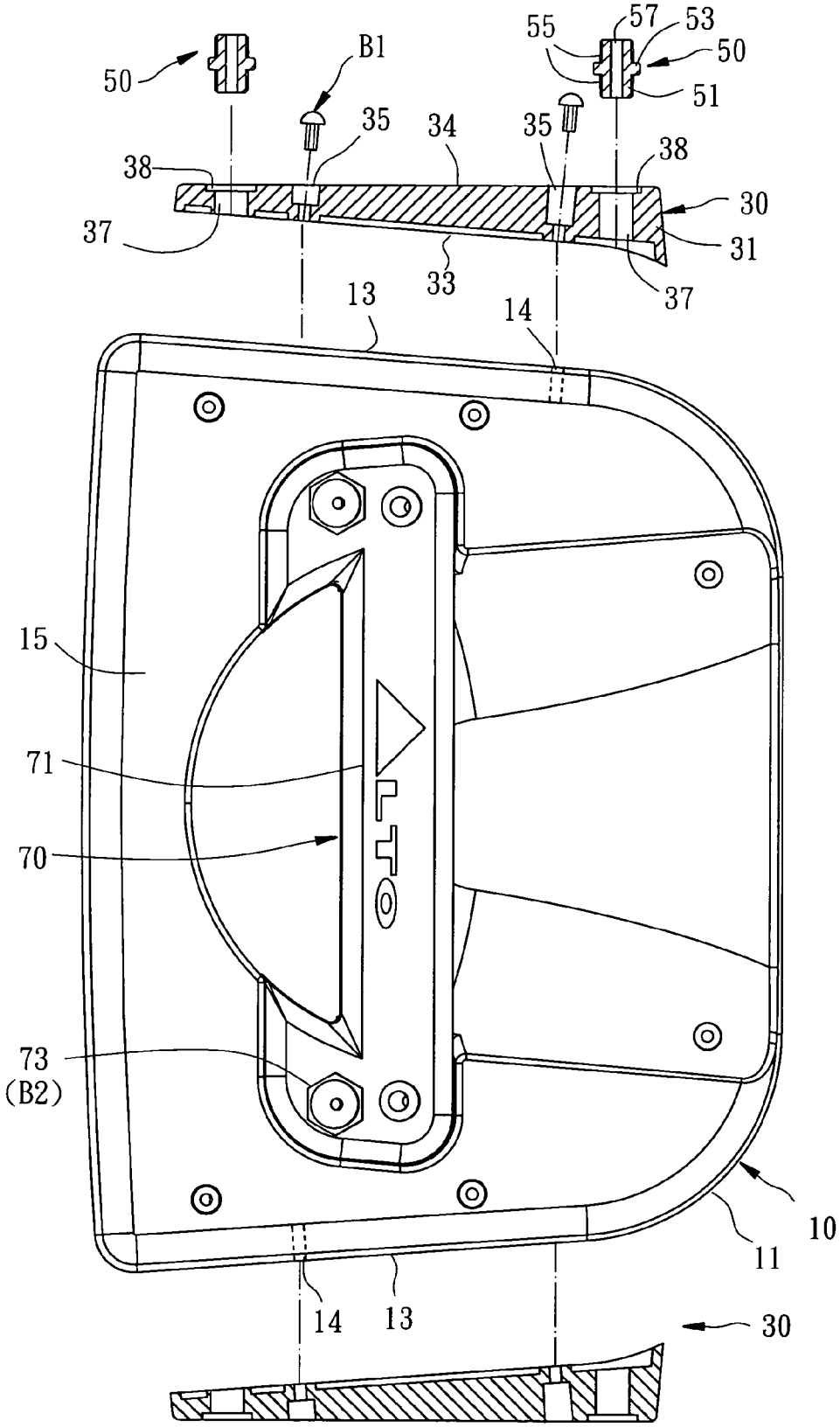
FIG. 3 is an exploded side plain view of the speaker stacking structure according to the present invention.

The assembly process of the present invention is outlined hereinafter with reference to FIGS. 2 and 3. Attach the mounting face 33 of each locating block 30 to each bearing wall 13 of the speaker 10 respectively, and then affix the respective mounting portions 35 to the respective mounting holes 14 by screws B1.

Figure 4:
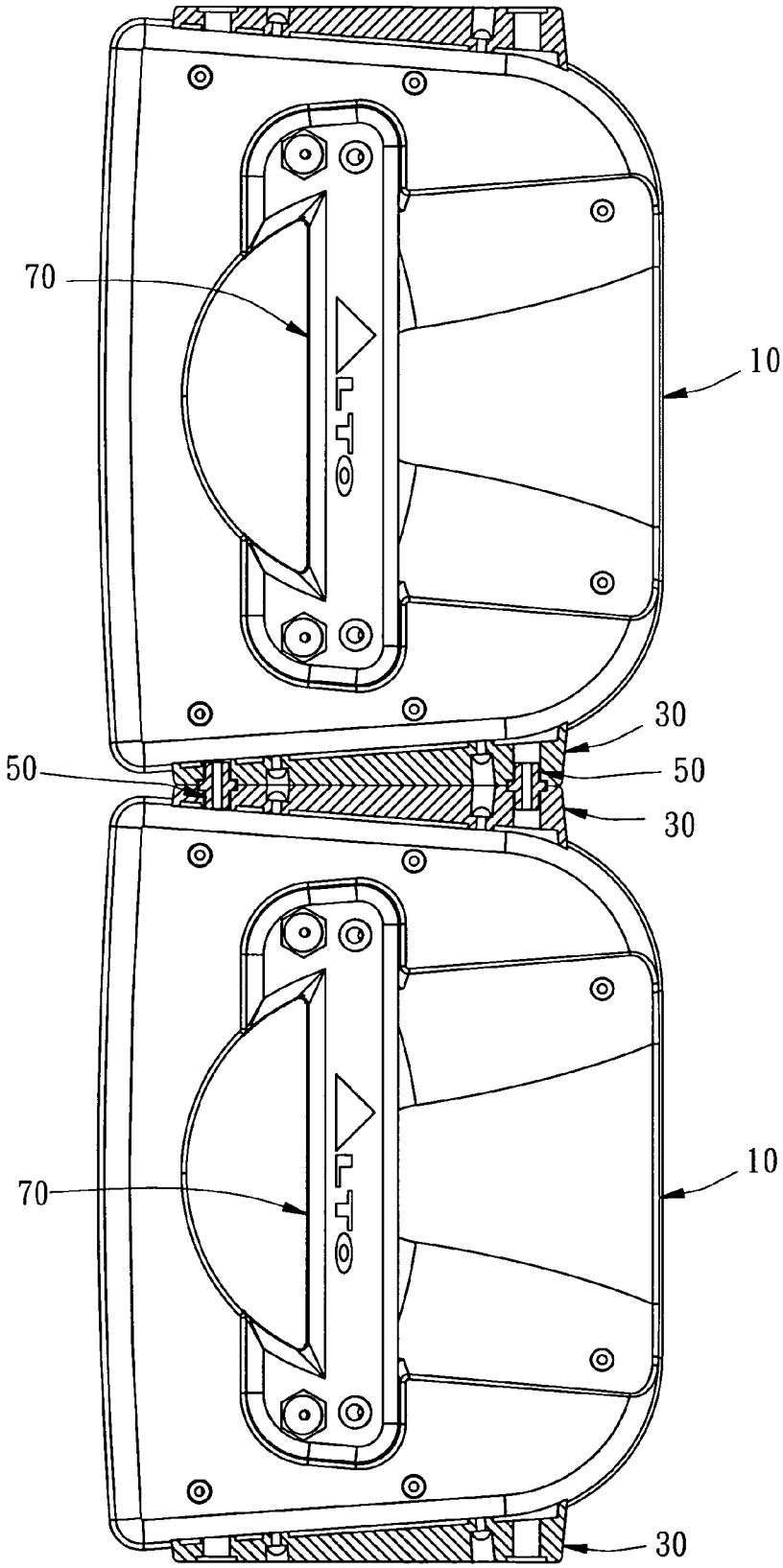
FIG. 4 is a side plain view showing two speakers arranged in a stack according to the present invention.
Figure 5:
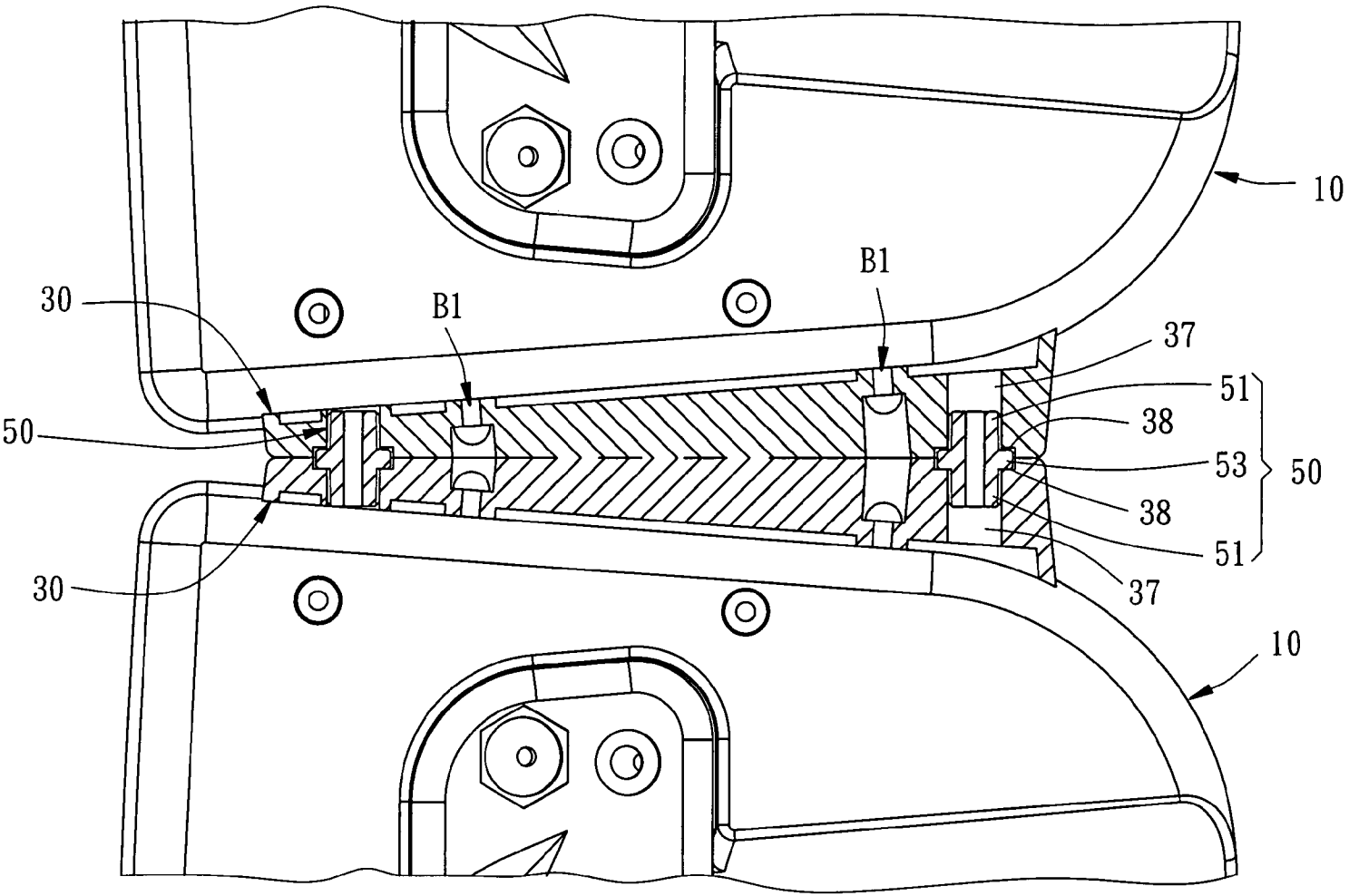
FIG. 5 is an enlarged view of a part of FIG. 4.

When wishing to arrange two speakers 10 in a space, as shown in FIGS. 4 and 5, insert the stems 51 of the fastening members 50 into the plugholes 37 in the locating blocks 30 at one bearing wall 13 of the speaker cabinet 11 of the first speaker, and then couple the plugholes 37 in the locating blocks 30 at one bearing wall 13 of the speaker cabinet 11 of the second speaker to the stems 51 of the installed fastening members 50, and thus the two speakers are arranged in a stack.

The speaker stacking structure can be designed for enabling a number of speakers to be connected in series in horizontal direction.

Figure 6:
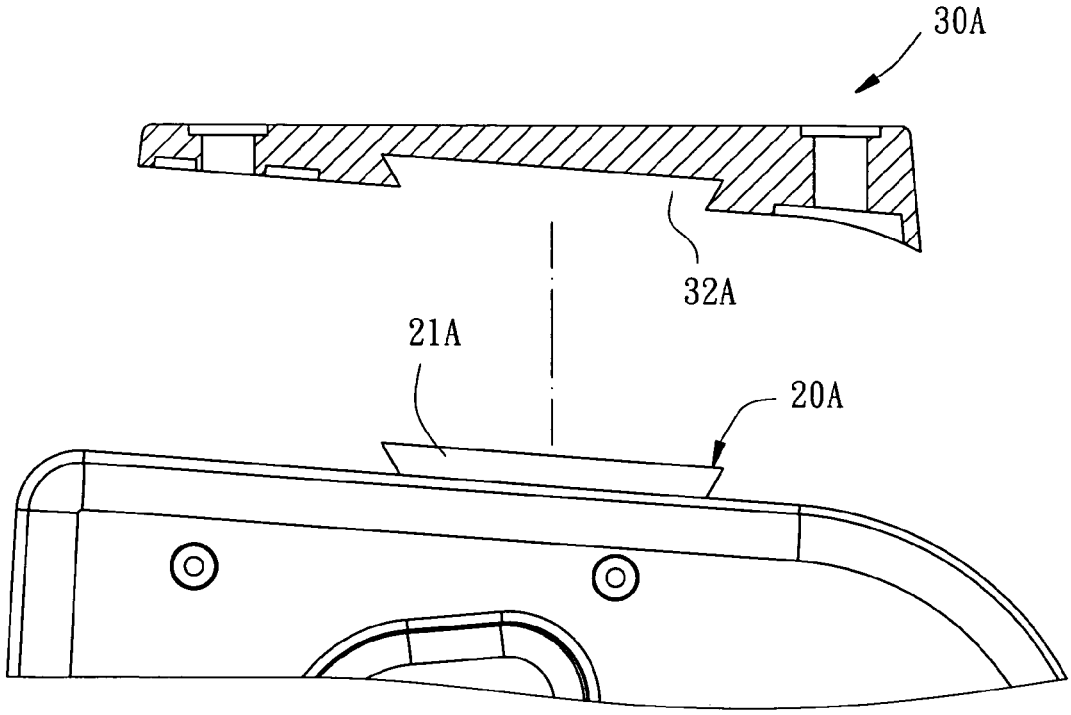
FIG. 6 is an exploded side plain view of a part of an alternate form of the speaker stacking structure according to the present invention.

FIG. 6 shows an alternate form of the present invention. According to this embodiment, each locating block 30A is adjustably slidably coupled to a respective coupling member 20A at the speaker. As illustrated, the coupling member 20A has a dovetail tongue 21A, and the locating block 30A has a dovetail groove 32A coupled to the dovetail tongue 21A. This design enables the user to adjust the pitch between the two locating blocks at each bearing wall of the speaker cabinet of the speaker.

Figure 7:
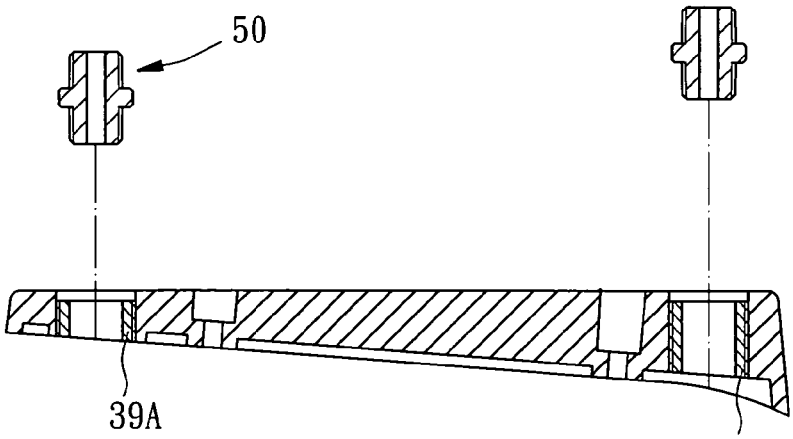
FIG. 7 is an exploded view in section of a part of another alternate form of the speaker stacking structure according to the present invention.

FIG. 7 shows another alternate form of the present invention. According to this embodiment, fitting elements 39A are selectively mounted in each locating block for accommodating a respective fastening member 50. The fitting elements 39A define a respective plughole for receiving a respective fastening member 50.

Further, the locating blocks may be directly molded from plastics on the speaker cabinet.

As indicated above, the invention has the following features:

1. The invention enables a number of speakers to be conveniently arranged in a stack without the use of any other positioning structure or apparatus.

2. The invention enables the user to arrange a number of speakers in a stack easily, keeping the arranged stack of speakers firmly in unity to cause a sense of beauty.

3. The invention enables a number of speakers of different sizes to be arranged in a stack to form one of a variety of combinations.

What is claimed is:

1. A speaker stacking structure comprising:

a speaker, said speaker having a speaker cabinet, said speaker cabinet having a receiving chamber adapted to accommodate speaker circuit means, and two bearing walls disposed at two opposite sides;

a plurality of locating blocks respectively symmetrically fastened to said bearing walls of said speaker, said locating blocks each having a block body, said block body having a mounting face and a bearing face opposite to said mounting face, said mounting face being disposed in contact with said bearing wall of said speaker, said bearing face being disposed in contact with said bearing face of another locating block, a mounting device respectively fastened to said bearing wall of the speaker, and a plughole; and a plurality of fastening members adapted to connect two speakers together, said fastening members each having a stem insertable into said plughole of each said locating block.

2. The speaker stacking structure as claimed in claim 1, wherein said locating blocks are respectively formed integral with said bearing walls of said speaker.

3. The speaker stacking structure as claimed in claim 1, wherein said locating blocks are respectively slidably coupled to said bearing walls of said speaker.

4. The speaker stacking structure as claimed in claim 1, wherein said locating blocks each are embedded with a fitting member defining therein said plughole.

5. The speaker stacking structure as claimed in claim 1, wherein said speaker has a handle holder, said handle holder each being disposed at one end of said speaker cabinet, and a handle respectively fastened to said handle holder.

6. The speaker stacking structure as claimed in claim 5, wherein said speaker has two handle holders respectively disposed at two ends of said speaker cabinet, and said handle each have two mounting portions respectively fastened to said handle holders.

7. The speaker stacking structure as claimed in claim 1, wherein said locating blocks each further have a countersunk hole respectively formed in said bearing face and integral with one end of said plughole.

8. The speaker stacking structure as claimed in claim 1, wherein said speaker has a plurality of mounting holes symmetrically formed in said bearing walls of said speaker cabinet; said mounting device of each said locating block are countersunk holes respectively fastened to said mounting holes in said bearing walls of said speaker cabinet.

9. The speaker stacking structure as claimed in claim 1, wherein said fastening members each further have a shoulder extended around said periphery of said stem thereof.

10. The speaker stacking structure as claimed in claim 1, wherein said fastening members each further have a plurality of threads extended around said periphery of said stem thereof.

* * * * *